US008857401B2

(12) United States Patent
Gunning

(10) Patent No.: US 8,857,401 B2
(45) Date of Patent: Oct. 14, 2014

(54) LOW DRAG PISTON

(76) Inventor: Rohan Gunning, Defuniak Springs, FL (US)

( * ) Notice: Subject to any disclaimer, the term of this patent is extended or adjusted under 35 U.S.C. 154(b) by 294 days.

(21) Appl. No.: 13/415,038

(22) Filed: Mar. 8, 2012

(65) Prior Publication Data

US 2012/0227700 A1 Sep. 13, 2012

Related U.S. Application Data

(60) Provisional application No. 61/450,451, filed on Mar. 8, 2011.

(51) Int. Cl.
*F02B 19/18* (2006.01)
*F02F 3/28* (2006.01)

(52) U.S. Cl.
USPC ..... 123/193.6

(58) Field of Classification Search
USPC ..... 123/193.6, 286, 302, 268, 275; 92/176–189
IPC ..... F02F 3/00,3/22
See application file for complete search history.

(56) References Cited

U.S. PATENT DOCUMENTS 2,840,427 A * 6/1958 Dolza ..... 92/176
3,654,840 A 4/1972 Elliott
3,983,793 A * 10/1976 Beardmore ..... 92/190
4,178,899 A * 12/1979 Julich ..... 123/193.6
4,648,309 A 3/1987 Schellmann
4,651,629 A * 3/1987 Castarede ..... 92/176
4,805,518 A * 2/1989 Heban, Jr. ..... 92/189
4,809,591 A 3/1989 Rhodes
5,309,879 A * 5/1994 Regueiro ..... 123/286
6,206,248 B1 3/2001 Popp
6,427,517 B1 8/2002 McMillan
6,487,773 B1 * 12/2002 Scharp et al. ..... 29/888.04
6,935,220 B2 8/2005 Dunaevsky
8,047,123 B2 * 11/2011 Lahrman ..... 92/186
8,601,996 B2 * 12/2013 Miller et al. ..... 123/193.6
2001/0027607 A1 * 10/2001 Ries ..... 29/888.04
2004/0237775 A1 * 12/2004 Dunaevsky et al. ..... 92/160
2008/0148933 A1 * 6/2008 Fisher et al. ..... 92/172
2011/0107997 A1 * 5/2011 Muscas et al. ..... 123/193.6
2011/0114054 A1 * 5/2011 Miller et al. ..... 123/193.6

* cited by examiner

*Primary Examiner* — M. McMahon
(74) *Attorney, Agent, or Firm* — Daniel Boudwin; Global Intellectual Property Agency LLC

(57) ABSTRACT

Disclosed is a low drag piston for a reciprocating engine that comprises a piston head that reduces mechanical and viscous friction while improving oil lubrication and thermal load dissipation throughout the piston stroke. The piston comprises a cylindrical crown and lower skirt area such that these elements are the only surfaces in contact with the cylinder walls and support a plurality of piston rings, while the interior skirt region is recessed inward in a concave shape to reduce drag, friction and thermal expansion interferences. An additional oil control ring increases oil outflow to further reduce friction and drag, while the pin boss that holds the connection between the piston head and the connecting rods is recessed inward within the inwardly concave central portion.

1 Claim, 3 Drawing Sheets

LOW DRAG PISTON

CROSS REFERENCE TO RELATED APPLICATION

This application claims the benefit of U.S. Provisional Application No. 61/450,451 filed on Mar. 8, 2011, entitled "Low Drag Automotive Piston."

BACKGROUND OF THE INVENTION

1. Field of the Invention

The present invention relates to reciprocating engines and piston designs, particularly in the automotive field. More specifically, the present invention pertains to a high efficiency piston that reduces viscous drag and mechanical losses as it translates through its range of motion from bottom dead center (BDC) to top dead center (TDC) within a reciprocating engine.

Reciprocating engines utilize a piston-cylinder configuration to capture the power of expanding gases to create work in the form of translation of the piston within the cylinder, which in turn rotates a crank to power a vehicle, operate an electrical generator or perform a duty unto which rotating mechanical power is a motive input. An engine piston is positioned within a cylinder with minimal clearance and tight tolerancing, wherein the interface between the piston and cylinder bore is heavily lubricated via the continual application of oil along the cylinder walls during operation. Proper oiling of the cylinder during engine operation is critical to controlling and preventing excessive thermal load build-up, frictional losses and even engine seizure. Typical piston-cylinder devices are comprised of a metallic structure, which expands readily under thermal load. Intense heat due to the ignition of the engine fuel-air mixture within the cylinder conducts through the walls of both the piston and cylinder, resulting in a large thermal flux and the relative expansion of components within the engine. To prevent these components from expanding excessively and clashing with one another, proper lubrication and engine design is critical, and further reduces frictional wear and improves engine longevity.

The interface between the piston and cylinder of a reciprocating engine is a piston ring device. Piston rings are peripherally mounted about the outer diameter of the piston head and are positioned within grooves therealong. The piston rings are generally semi-circular rings that are allowed to expand under thermal load without creating an interference, while their positioning on the cylinder head serves two primary functions. The first of which is to prevent the fuel-air mixture within the piston from bypassing the piston head during expansion, and thus retaining proper compression within the cylinder and allowing the expanding gases to convert its kinetic energy into piston work as designed. The second function of the piston rings is to skim oil from the cylinder bore as it translates therein. Oil is sprayed along the piston interior bore to facilitate reduced friction and heat, and thus reduced wear. The piston ring leave a lubricating oil film of a few micrometers thick on the bore surface, so as the piston descends along its path within the cylinder, the thin film provides adequate lubrication, heat dissipation and thus reduced wear on the engine. Piston rings can thus be differentiated as either compression rings and oil control rings, wherein their moniker denotes their function. Most reciprocating engines employ a plurality of piston rings for the foregoing functions, wherein one or a plurality of a single piston ring type may be deployed for improved function and thus improved compression sealing and oil control. Dual compression rings may prevent undesired loss of compression, while dual oil control rings prevent build-up of oil along the bore if the oil is less than uniform, and further prevent oil from entering the fuel-air mixture and burning.

While piston rings may facilitate a thin film of lubrication, there still exits friction between the piston and the cylinder during operation, in the form of viscous drag (fluid friction) and mechanical friction. The present invention relates to a piston design that is adapted to provide improved mechanical efficiency, smoother operation of the engine and lower emissions as the life of the engine increases. Typical pistons employ a cylindrical head and a similarly cylindrical piston skirt, which extends over the connection to the piston rod. As such engines increase in temperature and even begin to overheat (if adequate cooling is not provided), expansion under thermal load occurs, leading to increased friction between the piston and cylinder bore and potentially a seizure of the engine itself, as the friction between the components becomes too great or they fuse together under intense heat.

The present invention is specifically related to a piston shape that comprises a cylindrical piston head, wherein the piston skirt is a tapered shape having an inwardly concave central portion before terminating at a lower portion of equal radius as the upper piston head. This shape allows the piston to dissipate heat through the lower portion and reduces expansion under considerable thermal load, while the concave shape allows for material growth without risking seizure of the engine. Current piston designs have considerably high mechanical losses with regard to the energy wasted from the expanding gases in the form of mechanical friction and oil drag. The present invention is a more efficient component that not only reduces these power robbing elements, but also decreases the amount of fuel needed to efficiently operate the engine, while also increasing the longevity of any engine equipped with the present piston configuration. Hydrocarbon emissions are also reduced, as the piston rings are more effective at sealing the combustion chamber and less oil is burned during an engine cycle. The present invention is designed to provide an engine that runs quiter, cooler, and still prevents excessive oil consumption in excessively high mileage vehicles.

2. Description of the Prior Art

Several devices have been disclosed in the prior art that relate to piston designs and those that relate to improved mechanical efficiency. Several devices have been patented or disclosed in published patent applications. These devices have familiar design elements for the purposes of providing a new piston configuration for a reciprocating engine; however none are provided in the configuration as disclosed in the present invention. The disclosures deemed most relevant to the present invention are described below.

Specifically, U.S. Pat. No. 6,206,248 to Popp, U.S. Pat. No. 4,809,591 to Rhodes, and U.S. Pat. No. 4,648,309 to Schellmann all disclose pistons having a particular shape so as to reduce friction and wear on the inner bore of a cylinder. These devices include piston skirts that comprise inwardly shaped profiles, but fail to disclose a concave shape having a recessed pin boss and a lower oil control ring to facilitate reduced friction and improved lubrication throughout the engine cycle. These prior art devices are well adapted for their particular purpose, but fail to disclose a piston having an inwardly concave central portion with a first and second oil control ring on either side of the concave portion.

The present invention provides a new and improved piston shape that reduces potential contact area between the central portion of the piston and the cylinder bore, while also improving lubrication in the form of a plurality of oil control rings surrounding the inwardly concave central portion of the piston. The result is reduced friction, reduced mechanical losses, increased heat dissipation and a smoother running engine that can reduce wear in high mileage engines. It is submitted that the present invention is substantially divergent in design elements from the prior art, and consequently it is clear that there is a need in the art for an improvement to existing devices. In this regard the instant invention substantially fulfills these needs.

SUMMARY OF THE INVENTION

In view of the foregoing disadvantages inherent in the known types of low drag pistons now present in the prior art, the present invention provides a new reciprocating engine piston wherein the same can be utilized for providing convenience for the user when reducing mechanical losses, friction and improving efficiency of a reciprocating engine.

It is therefore an object of the present invention to provide a new and improved piston device that has all of the advantages of the prior art and none of the disadvantages.

It is another object of the present invention to provide a new reciprocating engine piston that is adapted to reduce mechanical friction, viscous drag and improve thermal load dissipation under high heat conditions.

Another object of the present invention is to provide a new reciprocating engine piston that reduces wear by having improved clearance between the piston and cylinder along the central portion of the cylinder, improving mechanical efficiency and longevity of the engine.

Yet another object of the present invention is to provide new reciprocating engine piston that incorporates a first and second oil control ring above and below its recessed central portion, allowing improved oil control, lubrication and reduced oil burning.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 2:
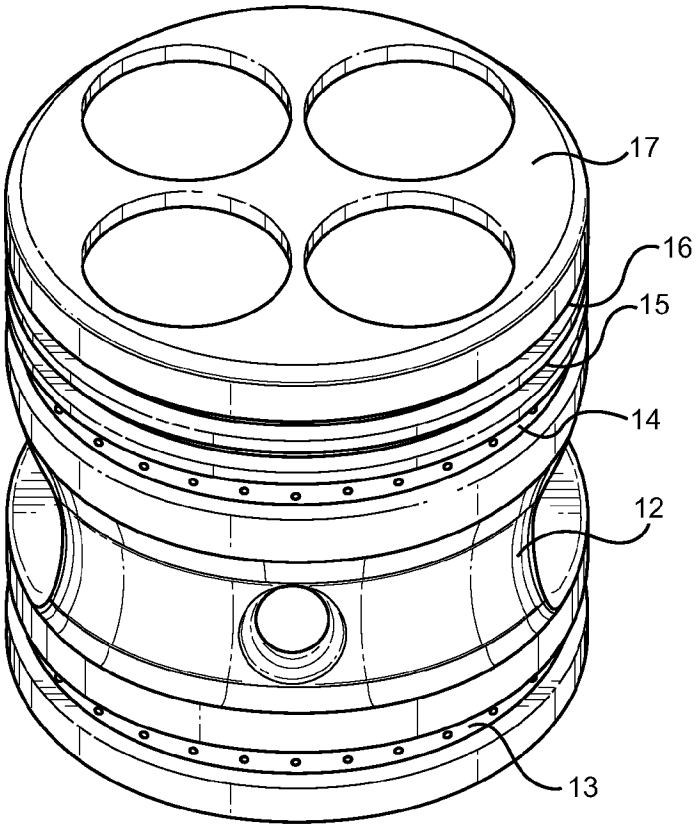
FIG. 2 shows an overhead view of the piston of the present invention.

Reference is made herein to the attached drawings. Like reference numerals are used throughout the drawings to depict like or similar elements of the low drag piston. For the purposes of presenting a brief and clear description of the present invention, the preferred embodiment will be discussed as used for reducing friction, mechanical losses and improving engine efficiency within a reciprocating engine. The figures are intended for representative purposes only and should not be considered to be limiting in any respect.

Figure 1:
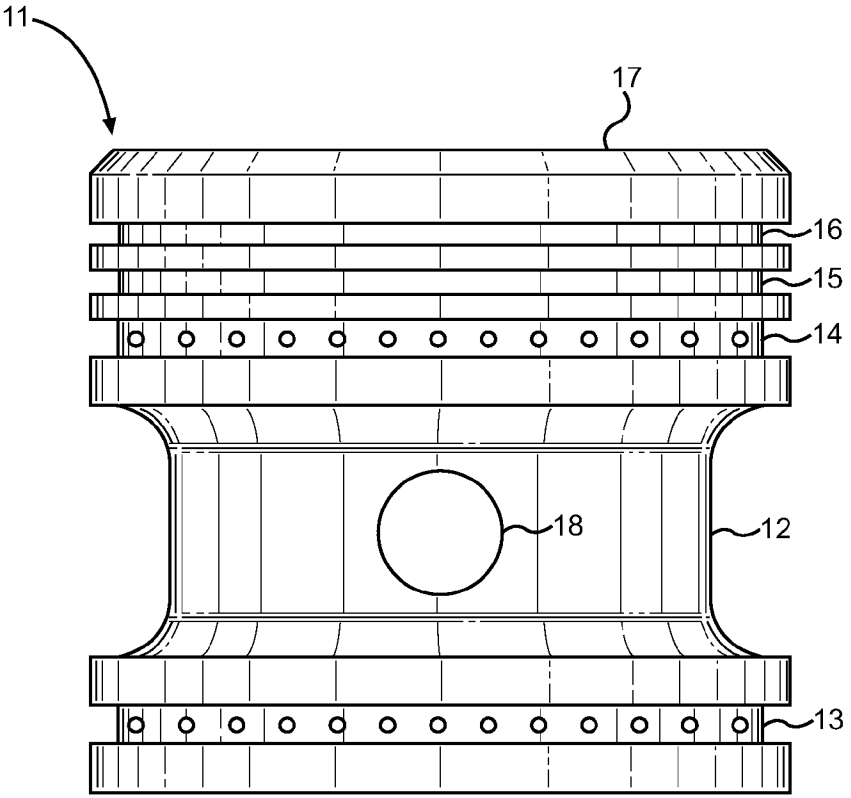
FIG. 1 shows an side view of the piston of the present invention.
Figure 3:
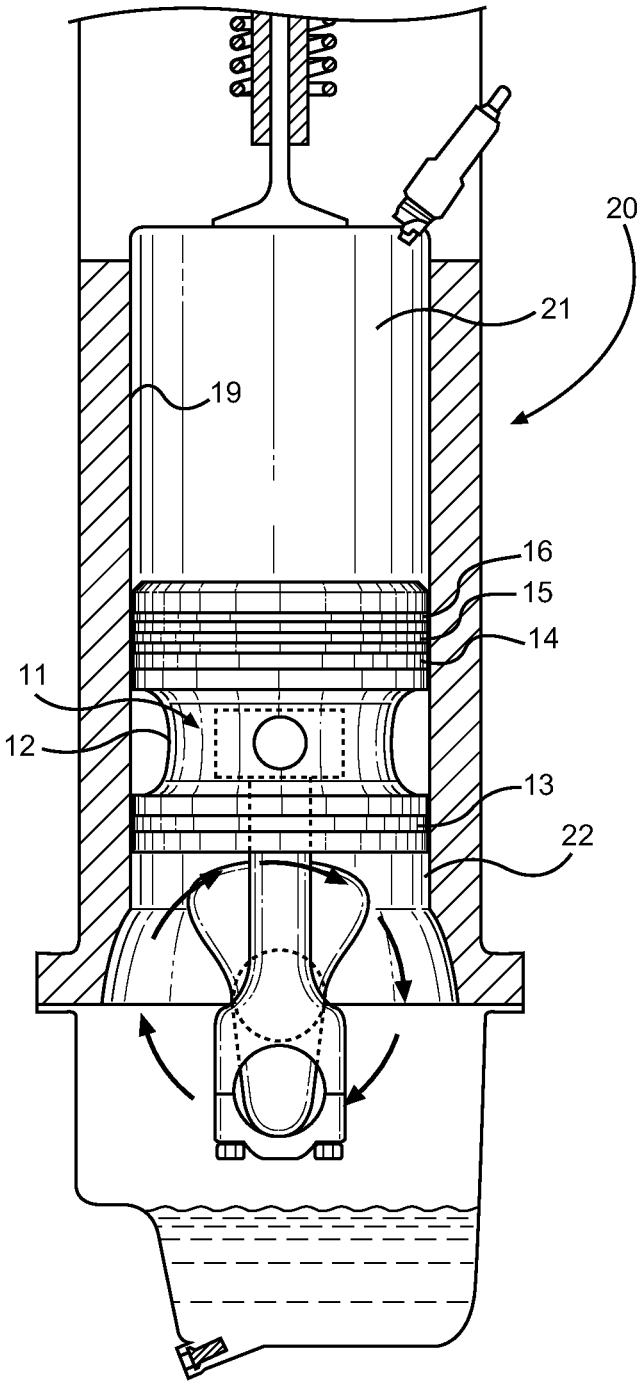
FIG. 3 shows a cross section view of the present invention in operation within a reciprocating engine.
Figure 5:
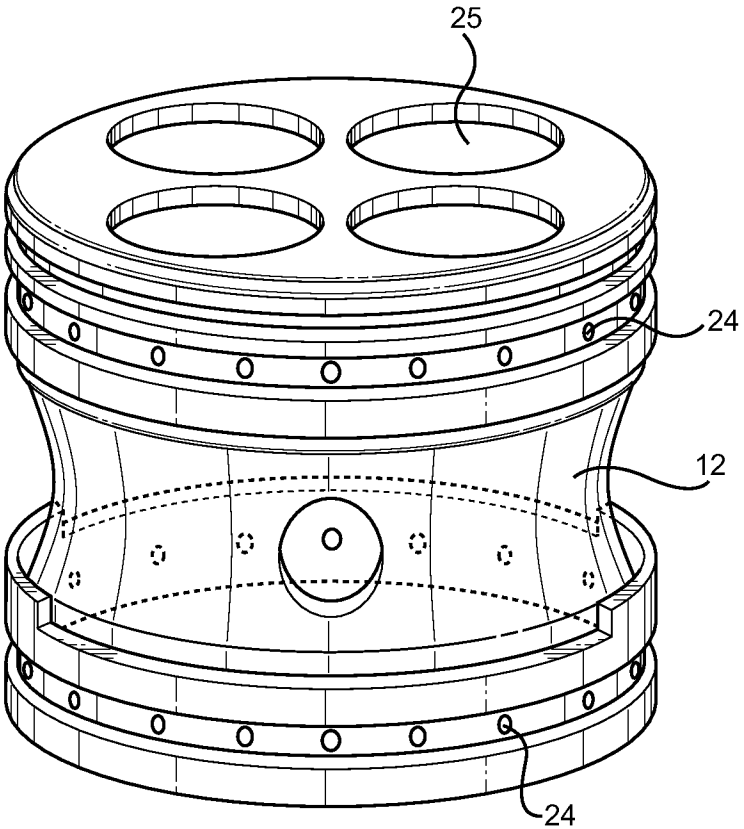
FIG. 5 shows another side view of the present invention.
Figure 4:
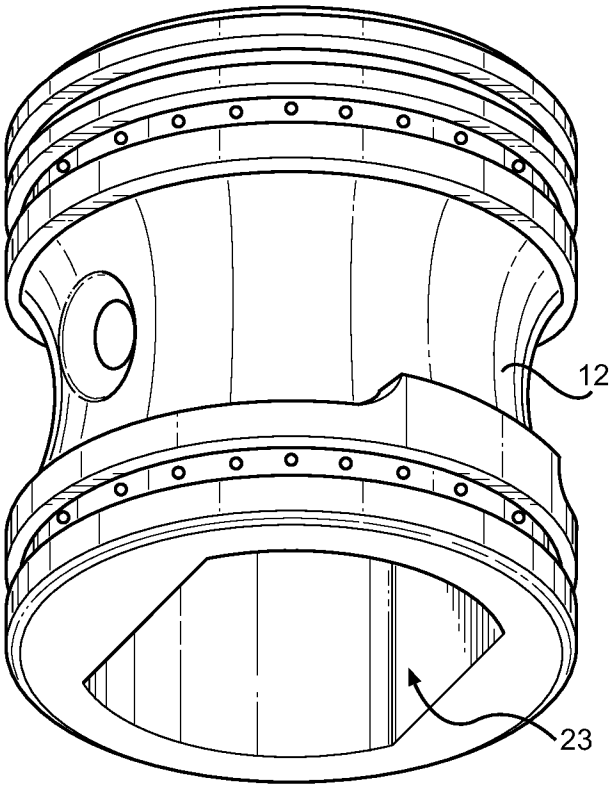
FIG. 4 shows an underside view of the present invention.

Referring now to FIG. 1 through 5, there is shown a view of the low drag piston of the present invention. The piston 11 is a cylindrical device adapted to travel within a reciprocating engine and utilize the power of an expanding fuel-air mixture to turn a crank shaft. Its function is to utilize the expanding gases while sealing the combustion chamber and controlling lubrication along the interface between the piston and the bore of a cylinder. The present invention comprises a piston crown 17 having a largely cylindrical shape, connected to a recessed central region 12 and terminating in a lower piston skirt portion that is of equate diameter as the piston crown region. This shape reduces the contact areas for which the piston can contact the inner cylinder walls during operation, wherein thermal expansion is accounted for to reduce increased friction and wear. The crow region 17 further comprises a plurality of piston ring grooves, including at least one compression ring groove 15, 16, and a first oil control ring groove 14. The compression ring grooves are adapted to secure piston rings that prevent the expanding fuel-air mixture within the compression chamber from bypassing the piston crown, and thus creating a sealed compression chamber to harness the full energy potential of the expanding gases. The first oil control ring groove 14 is adapted to secure a piston ring that controls the thickness of a layer of oil along the cylinder walls, such that the piston and cylinder are adequately lubricated throughout the motion of the piston. This groove may include a plurality of oil apertures within the groove 14 to divert the flow of oil.

Along the lower piston skirt portion is a second oil control groove, which provides further control of the lubrication within the reciprocating engine and prevents increased friction, wear and heat build-up. Between the piston crown 17 region and the lower skirt portion is a recessed area 12 that is inwardly concave and provides connection 18 to the piston pin boss. This inwardly concave area 12 draws the shape of the piston away from the walls of the cylinder to reduce potential contact points as the piston and cylinder undergo thermal expansion during operation.

Strict attention is paid to the shape of the piston component and by strategically placing a second oil control ring on the lower portion of the piston skirt, greater operating efficiency is attained. Aside from the concave central portion of the skirt and pin boss that surrounds the entire piston circumference, there is the aforementioned oil control ring, similar in design to the piston crown region. The present invention contemplates either single or dual compression rings, while providing a first and second oil control ring on either side of the recessed skirt area 12.

Construction of the piston may be accomplished via casting or forging aluminum alloy. To cast a piston, aluminum alloy ingots are heated until molten then poured into preheated molds. The raw casting is then cooled gradually in a controlled environment then separated from the mold to be reheated later to a lower temperature to allow the alloy to stabilize. The casting is then inspected for defects, sonic tested for consistency then degreased. It is then turned on a lathe to create the general shape of the finished product. It is turned a second or third time to achieve the final dimensions of the finished piston. The piston is then ready for drilling. The wrist pin hole is drilled through the pin boss and then small oil drain holes in the ring grooves for the oil control rings. The pin boss hole is then polished along with the lands and crown. Engraving important information then becomes necessary. The piston is washed and dried in preparation for an anodized finish. Other scuff resistant finishes include tin and graphite. Piston rings are carefully sized before fitting. Compression is controlled by milling or dishing in the piston crown. If forging is preferred by certain manufacturers for racing or heavy duty use, the new design lends itself to this construction method as well. Forging a piston requires cutting a solid piece of aluminum rod into appropriate lengths. These slugs are then heated up in an oven and then sent to a punch press that has been preheated to the same temperature of about 500 degrees Fahrenheit. The slug is then removed from the oven and before it has a chance to cool is hammered by the press using 2,000 tons of pressure. There are dies above, below, and all around the slug that give it the basic shape of a finished piston. The forging requires an hour to cool down. The forging must then be heat treated in an oven. This process tempers the forging. The forging is allowed to cool then is sent through the oven again at a lower temperature to stabilize the forging. It is then turned on a lathe. Once to give the basic shape of the end product, then again to finish the new piston to its exact dimensions as well as to cut and polish ring grooves. Next the wrist pin hole is drilled along with the oil drain holes of the oil control rings. Finally the piston crown is milled to give the desired compression ratio then engraved to with pertinent information. The rings are made and sized to fit the piston. The freshly minted piston is then washed and prepared for use.

The present low drag piston of the present invention is designed to curtail oil consumption through a more efficient scraping of oil along the cylinder walls while reducing piston expansion if an engine should somehow overheat, extending engine life and reliability. It is contemplated that a 1.5 to 2.0 mile increase per gallon in a four or six cylinder automotive engine may be created through the use of the present invention, while less oil is mixed with the contaminates of combustion to reduce emissions and oil consumption. Most automotive engineers simply rely on synthetic and high end lubricants to deal with these problems. The present invention creates a new piston design that can overcome nonuniform oil viscosity and density by providing dual oil control rings and a recessed skirt portion to improve lubrication and engine efficiency. As engine rotational speed approach mid-range for a particular engine design, more oil is thrown onto cylinder bores by the crankshaft that must be scraped therefrom by oil control rings below the lower compression ring. As quickly as the oil is thrown onto the bores, it must be scraped off so as not to impede piston motion. This impediment requires a richer (stronger) fuel mixture to enable the pistons to continue working, which in turn causes higher peak hydrocarbon and carbon monoxide emissions. Then as the engine components develop wear after several years of operation, oil consumption becomes an important factor due to the amount of oil leaking past oil control rings and mixing with the air/fuel mixture in the combustion chamber and burning as part of the combustion process. The present invention provides a new and novel means of control oil along the cylinder walls, while incorporating a piston shape that facilitates heat dissipation, reduces thermal expansion and reduces contact interfaces between the piston and cylinder.

In light of the prior art and the given disclosure, it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An improved efficiency piston for a reciprocating engine, comprising:

a piston having an upper crown region, a lower skirt region and a central skirt portion;

said piston having a cylindrical shape, wherein said upper crown region and said lower skirt region are of equal diameter;

said upper crown region having an upper surface with four indentations;

wherein each of said four indentations is circular in shape and equal in size;

said central skirt portion comprising a recessed surface being inwardly concave, wherein said central skirt portion employs a reduced diameter with respect to said crown and lower skirt region;

said central skirt portion further comprising a pin boss connection;

said upper crown region having at least one compression ring groove;

said upper crown region having a first oil control ring groove;

said lower skirt region having a second oil control ring groove;

said lower skirt region having a pair of upward protruding tabs on opposing sides of said lower skirt region.

* * * * *